US007364152B2

(12) United States Patent
Suwa

(10) Patent No.: US 7,364,152 B2
(45) Date of Patent: Apr. 29, 2008

(54) SHEET FEEDING APPARATUS AND IMAGE FORMING APPARATUS

(75) Inventor: Yoshiyuki Suwa, Iwai (JP)

(73) Assignee: Canon Kabushiki Kaisha, Tokyo (JP)

( * ) Notice: Subject to any disclaimer, the term of this patent is extended or adjusted under 35 U.S.C. 154(b) by 247 days.

(21) Appl. No.: 11/008,974

(22) Filed: Dec. 13, 2004

(65) Prior Publication Data

US 2006/0157914 A1 Jul. 20, 2006

(30) Foreign Application Priority Data

Nov. 12, 2004 (JP) ..... 2004-329238

(51) Int. Cl.
*B65H 3/30* (2006.01)

(52) U.S. Cl. ..... 271/118; 271/126

(58) Field of Classification Search ..... 271/126, 271/117, 118, 157

See application file for complete search history.

(56) References Cited

U.S. PATENT DOCUMENTS 5,026,041 A 6/1991 Kitazume et al. ..... 271/118
5,253,854 A 10/1993 Tanoue et al. ..... 271/10
6,056,285 A * 5/2000 Kikuta et al. ..... 271/118
6,070,867 A 6/2000 Tsurumi et al. ..... 271/114
6,089,562 A * 7/2000 Jang et al. ..... 271/10.11
6,443,445 B1 9/2002 Bortolotti ..... 271/117
6,991,392 B2 * 1/2006 Hult et al. ..... 400/624

FOREIGN PATENT DOCUMENTS

JP 2-152824 6/1990
JP 4-350033 12/1992

* cited by examiner

*Primary Examiner*—Kaitlin S Joerger
(74) *Attorney, Agent, or Firm*—Fitzpatrick, Cella, Harper & Scinto

(57) ABSTRACT

In the course of sheet feeding by a sheet feeding roller, a depressing arm is depressed by a sheet feeding cam provided coaxially with the sheet feeding roller, whereby a depressing pawl is moved in a direction to be engaged with the stacking plate pawl of an stacking plate and further, with the depressing pawl engaged with the stacking plate pawl, the depressing arm is lowered by a constant amount to thereby depress the stacking plate, whereby irrespective of the amount of stacked sheets, the timing at which the sheets and the sheet feeding roller are spaced apart from each other is always the same and the amount by which the stacking plate is depressed also becomes constant.

9 Claims, 7 Drawing Sheets

SHEET FEEDING APPARATUS AND IMAGE FORMING APPARATUS

BACKGROUND OF THE INVENTION

1. Field of the Invention

The invention relates to a sheet feeding apparatus for supplying a sheet such as recording paper to an image forming apparatus such as a printer, a copying machine or a compound machine.

2. Description of Related Art

Among sheet feeding apparatuses, there is one which feeds sheets stacked on an stacking plate successively from the uppermost one of them to the image forming portion of an image forming apparatus by a sheet feeding roller, and such a sheet feeding apparatus is designed such that a rockably provided stacking plate is upwardly biased by a spring so that the uppermost surface of stacked sheets may be brought into pressure contact with a sheet feeding roller. There is also a sheet feeding apparatus designed such that as described in Japanese Patent Application Laid-open No. H04-350033, a sheet feeding cam is fixed coaxially with a sheet feeding roller, and in the course wherein the sheet feeding roller is rotated to thereby feed out a sheet, the sheet feeding cam depresses an stacking plate and lower the stacking plate to a predetermined position against the resilient force of a coil spring.

In a construction wherein as described above, the stacking plate is depressed by the sheet feeding cam, the stacking plate can be lowered to the predetermined position during waiting and therefore, the setting or interchange of the sheets is easy, and the stacking plate is lowered in the course wherein the sheet is fed out, whereby the separability of the sheet by separating means such as a separating pad can be improved.

However, in the sheet feeding apparatus of such a construction in which the stacking plate is automatically lowered to the predetermined position against the resilient force of the coil spring by the sheet feeding cam, the position of the stacking plate biased by the coil spring during sheet feeding differs in accordance with the stack amount (stack height) of the stacked sheets and therefore, the time from the start of the rotation of the sheet feeding roller until the sheet feeding cam abuts against the stacking plate to thereby depress the stacking plate differs depending on the stack amount of the sheets on the stacking plate. Therefore, there has been the problem that the timing at which the sheets stacked on the stacking plate are spaced apart from the sheet feeding roller becomes irregular and the separating performance of the separating means such as the separating pad is unstable.

Also, there has been the problem that the distance by which the uppermost surface of the sheets and the sheet feeding roller in the waiting state are spaced differs between a case where the stack amount of the sheets is great and a case where the stack amount of the sheets is small, and the time until during sheet feeding, the stacking plate is brought from its lowered position in the waiting state to a position in which the upper surface of the sheets comes into pressure contact with the sheet feeding roller differs and therefore, the feed timing for feeding out the sheet deviates and the sheet feeding interval (the interval between the sheets during continuous feeding) does not become constant. Further, there has also been the problem that when the stack amount of the sheets stacked on the stacking plate is small, the amount of movement of the sheets during the movement of the stacking plate between its lowered position and its elevated position becomes great, thus aggravating the aligning property of the stacked sheets. If the aligning property of the sheets is bad, there will arise the problem that when a sheet has been fed out, skew feeding is caused and a faulty image or jam or the like is liable to occur.

So, in order to solve these problems, it is conceivable to make the lowered position of the stacking plate not constant, but lower the stacking plate at the same timing irrespective of the amount of the stacked sheets and make the amount of lowering of the position of the uppermost surface of the sheets stacked on the stacking plate constant. There has been proposed a sheet feeding apparatus having a mechanism for moving up and down the stacking plate so as to make the lowering timing of the stacking plate the same and lowering the position of the uppermost surface of the sheets by a constant amount, as described above (see, for example, Japanese Patent Application Laid-open No. H02-152824 and U.S. Pat. No. 6,443,445).

However, the conventional sheet feeding apparatus having a construction in which the stacking plate is moved up and down so as to lower the upper surface of the sheets by a constant amount is very complicated in construction and requires many parts, and the cost as a sheet feeding apparatus increases remarkably. Further, the mounting of the many parts leads to the problem that the sheet feeding apparatus itself becomes bulky.

SUMMARY OF THE INVENTION

The present invention, in view of the above-noted problems, has as its object to provide a sheet feeding apparatus in which by a simple and inexpensive construction, irrespective of the stack height of sheets stacked on an stacking plate, the stacking plate is moved up and down substantially at the same timing and so as to lower the position of the uppermost surface of the sheets by a constant amount.

The present invention provides a sheet feeding apparatus having a pivotable stacking plate on which sheets are stacked, sheet feeding means for contacting with the sheets stacked on the stacking plate to thereby feed the sheets, biasing means for biasing the stacking plate to thereby bring the stacked sheets into pressure contact with the sheet feeding means, and a depressing mechanism for depressing the stacking plate against the biasing force of the biasing means, characterized in that the depressing mechanism is provided for movement in operative association with the rotation of the sheet feeding apparatus, one of the depressing mechanism and the stacking plate is provided with a plurality of pawl portions along a direction in which the stacking plate is depressed, and the other is provided with an engagement portion engageable with the pawl portions, and the depressing mechanism is moved so that during sheet feeding by the sheet feeding means, a pawl portion and the engagement portion may be engaged with each other, and subsequently is moved by a constant amount in a direction for spacing the stacking plate apart from the sheet feeding means against the biasing force of the biasing means.

The present invention provides a sheet feeding apparatus having a pivotable stacking plate on which sheets are stacked, a sheet feeding roller disposed above the stacking plate so as to contact with the sheets stacked on the stacking plate to thereby feed the sheets, a spring for upwardly biasing the stacking plate to bring the sheets stacked on the stacking plate into pressure contact with the sheet feeding roller, and a depressing mechanism for depressing the inner plate against the biasing force of the spring, the depressing mechanism has a sheet feeding cam fixed to the rotary shaft of the sheet feeding roller, a depressing arm provided in frictional contact with the sheet feeding cam, and vertically pivotable by the rotation of the sheet feeding cam, and a depressing pawl provided with a plurality of pawl portions engageable with the stacking plate along a direction in which the stacking plate is depressed, and held on the depressing arm for sliding movement in a direction intersecting with the rocking direction of the depressing arm, and when the depressing arm is depressed by the sheet feeding cam, the depressing pawl slides toward the stacking plate and the pawl portion come into engagement with the stacking plate, and subsequently depress the stacking plate by a constant amount.

The present invention provides a sheet feeding apparatus having a pivotable stacking plate on which sheets are stacked, a sheet feeding roller so as to contact with the sheets stacked on the stacking plate to thereby feed the sheets, a spring for upwardly biasing the stacking plate to bring the sheets stacked on the stacking plate into pressure contact with the sheet feeding roller, and a depressing mechanism for depressing the inner plate against the biasing force of the spring, the depressing mechanism has a sheet feeding cam provided on the rotary shaft of the sheet feeding roller, and a depressing pawl provided with a plurality of pawl portions engageable with the stacking plate along a direction in which the stacking plate is depressed, and provided in frictional contact with the sheet feeding cam and movable by the rotation of the sheet feeding cam, and when the depressing pawl is depressed by the sheet feeding cam, a pawl portion of the depressing pawl come into engagement with the stacking plate, and subsequently depress the stacking plate by a constant amount.

DETAILED DESCRIPTION OF THE PREFERRED EMBODIMENTS

Figure 6:
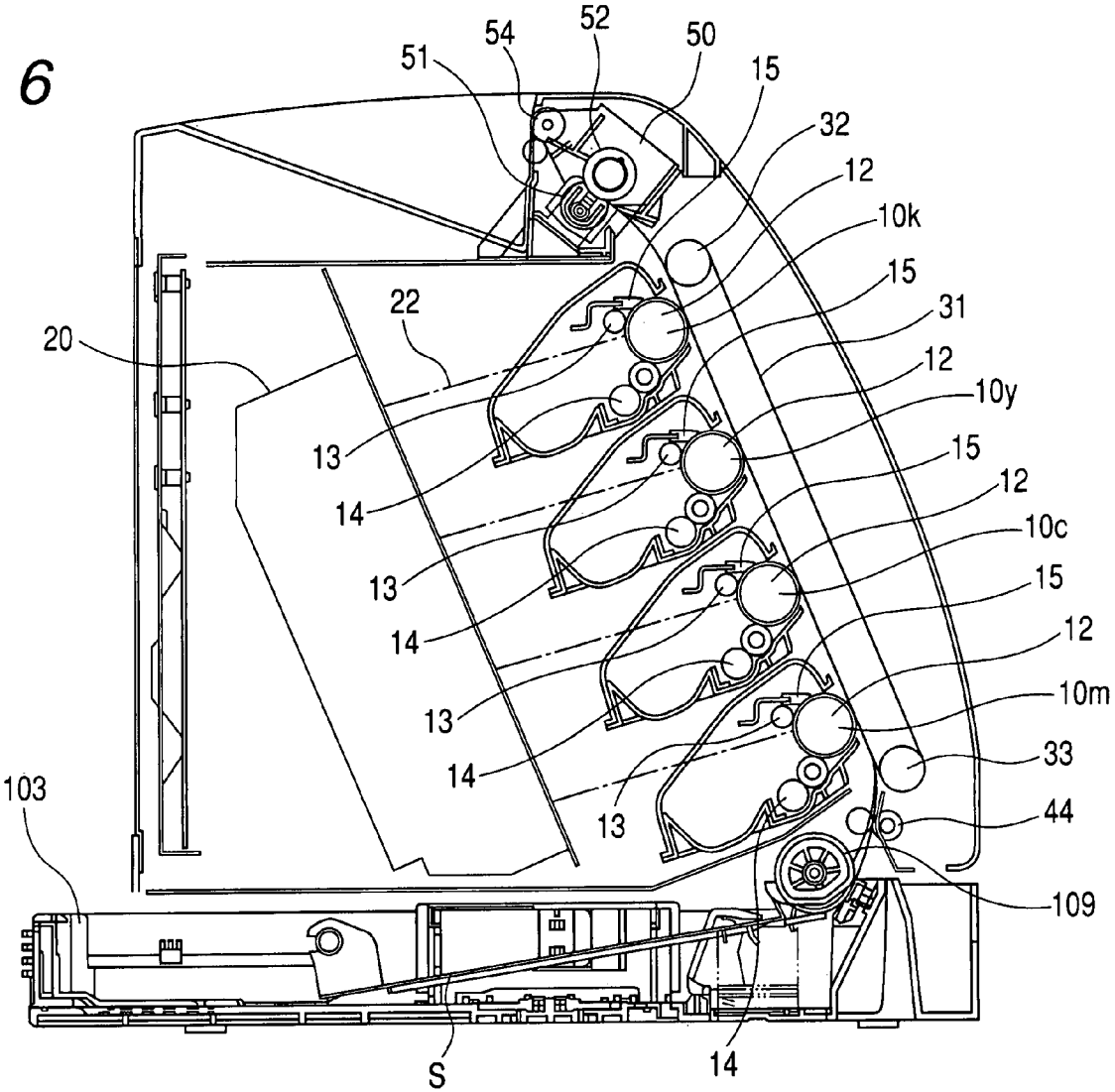
FIG. 6 is a cross-sectional view of an image forming apparatus provided with the sheet feeding apparatus of the present invention.

Reference is first had to FIG. 6 to schematically describe a color image forming apparatus on which the sheet feeding apparatus of the present invention is mounted.

The image forming portion of this color image forming apparatus enables process cartridges 10*m*, 10*c*, 10*y* and 10*k* of four colors to be detachably mounted on respective developing and forming stations, and is provided with an optical unit 20 capable of applying a laser beam, an electrostatic attracting and conveying belt 31, a fixing unit 50, etc. The process cartridges 10*m*, 10*c*, 10*y* and 10*k* are of the same structure, and in each of them, a photosensitive drum 12 which is an electrophotographic photosensitive member, charging means 13, a developing apparatus 14 and a cleaning apparatus 15 are integrally constructed.

The electrostatic attracting and conveying belt 31 is an endless belt member, and is rotatably supported by two rollers 32 and 33. A sheet S which is a transfer material is electrostatically attracted to and conveyed by the electrostatic attracting and conveying belt 31, and a toner image formed on each photosensitive drum 12 is transferred thereto by a transfer roller.

Also, in an image forming apparatus main body, there are disposed a sheet feeding roller 109, a pair of registration rollers 44, etc. to feed the sheet S from a sheet supplying cassette 103 which will be described later in detail to the electrostatic attracting and conveying belt 31.

The fixing unit 50 is disposed downstream of the process cartridges 10*m*, 10*c*, 10*y* and 10*k*, and this fixing unit 50 is provided with a fixing roller 51 and a pressure roller 52, and applies heat and pressure to the toner image on the sheet S to thereby effect fixing.

In the above-described construction, in the process cartridge 10*m* of the first color, e.g. magenta, the photosensitive drum 12 is first uniformly charged by the charging means 13, whereafter a latent image is formed thereon by a laser beam 22 applied from the optical unit 20, and this latent image is developed by the developing apparatus 14, whereby a toner image is formed. The toner image formed on the photosensitive drum 12 is transferred to the sheet S electrostatically attracted to and conveyed by the electrostatic attracting and conveying belt 31. The photosensitive drum 12 from which the transfer has been completed is cleaned by the cleaning apparatus 15 and is used for the next image forming. A similar image forming process is also carried out in each of the process cartridges 10*c*, 10*y* and 10*k*, whereby toner images of respective colors are formed and are successively superimposed on the previously formed toner image and transferred.

On the other hand, the sheet S is fed out of the sheet supplying cassette 103 by the sheet feeding roller 109, and is timed and conveyed onto the electrostatic attracting and conveying belt 31 by the registration rollers 44. The toner image formed on the photosensitive drum 12 is transferred to the sheet S by the action of a primary transfer roller. The sheet S to which the toner images have been thus transferred is conveyed to the fixing unit 50, and the toner images are fixed by the nip portion between the fixing roller 51 and the pressure roller 52, whereafter the sheet S is discharged by discharge rollers 54.

Figure 1:
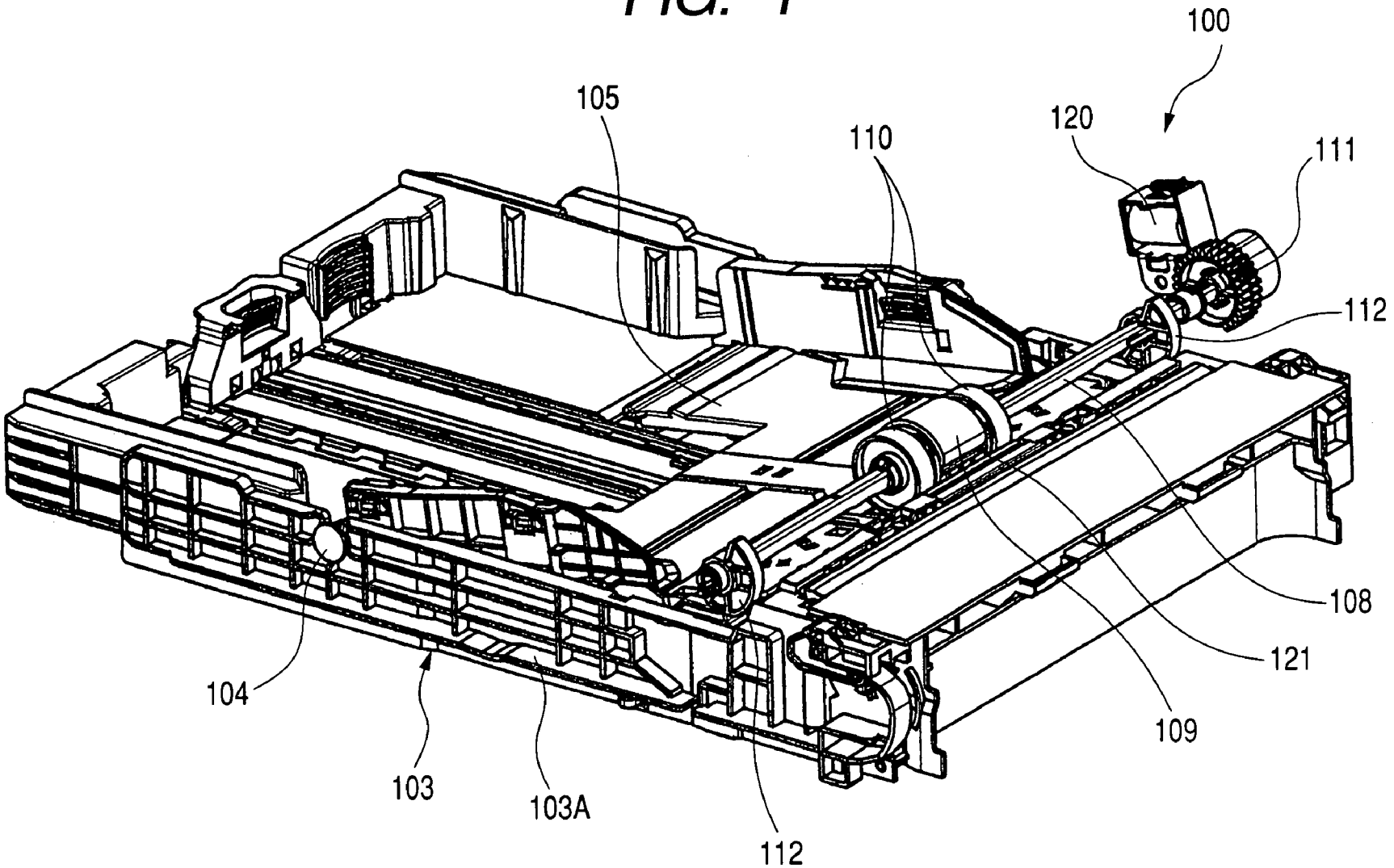
FIG. 1 is a perspective view of a sheet feeding apparatus according to a first embodiment of the present invention.
Figure 2:
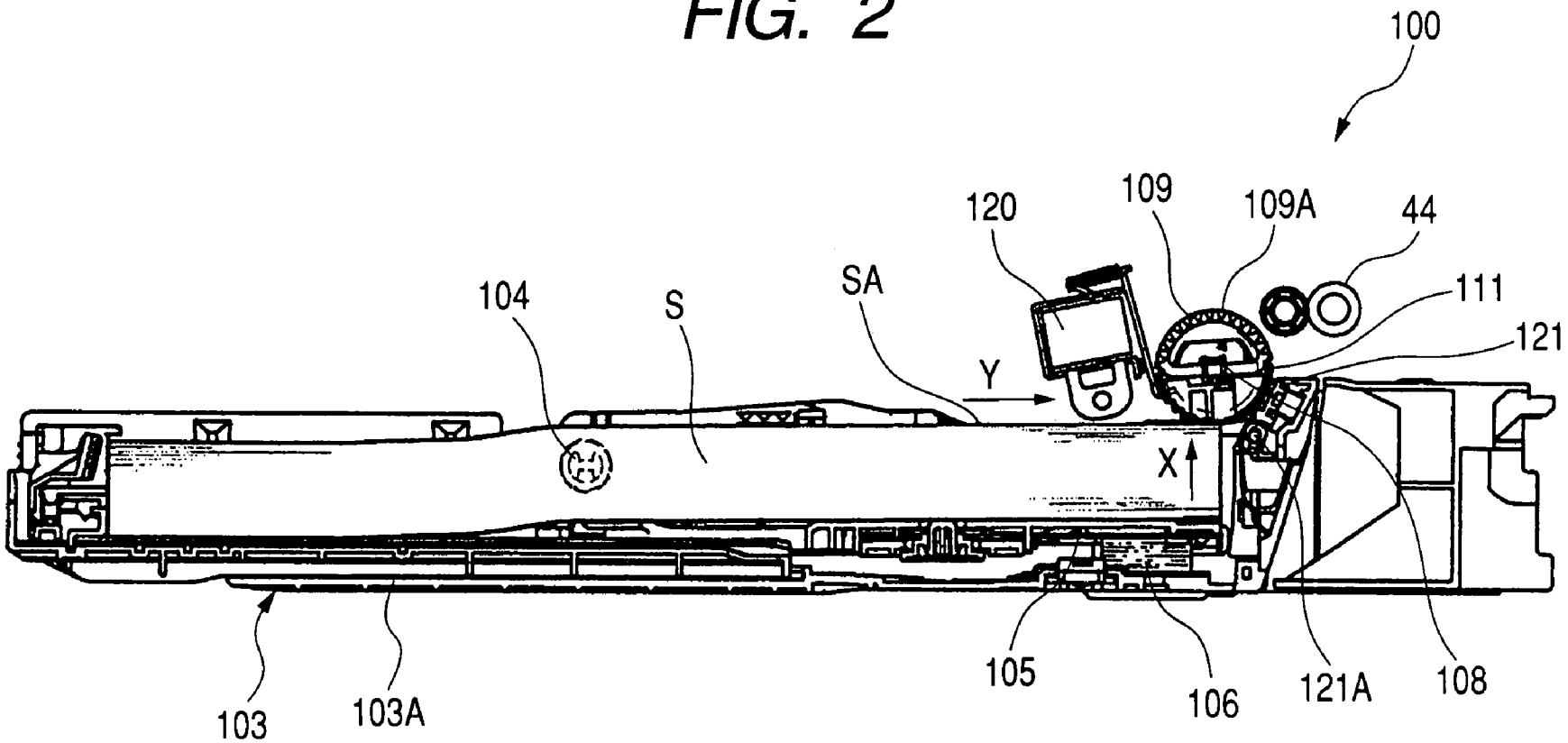
FIG. 2 is a cross-sectional view of the sheet feeding apparatus shown in FIG. 1 in its waiting state.
Figure 3:
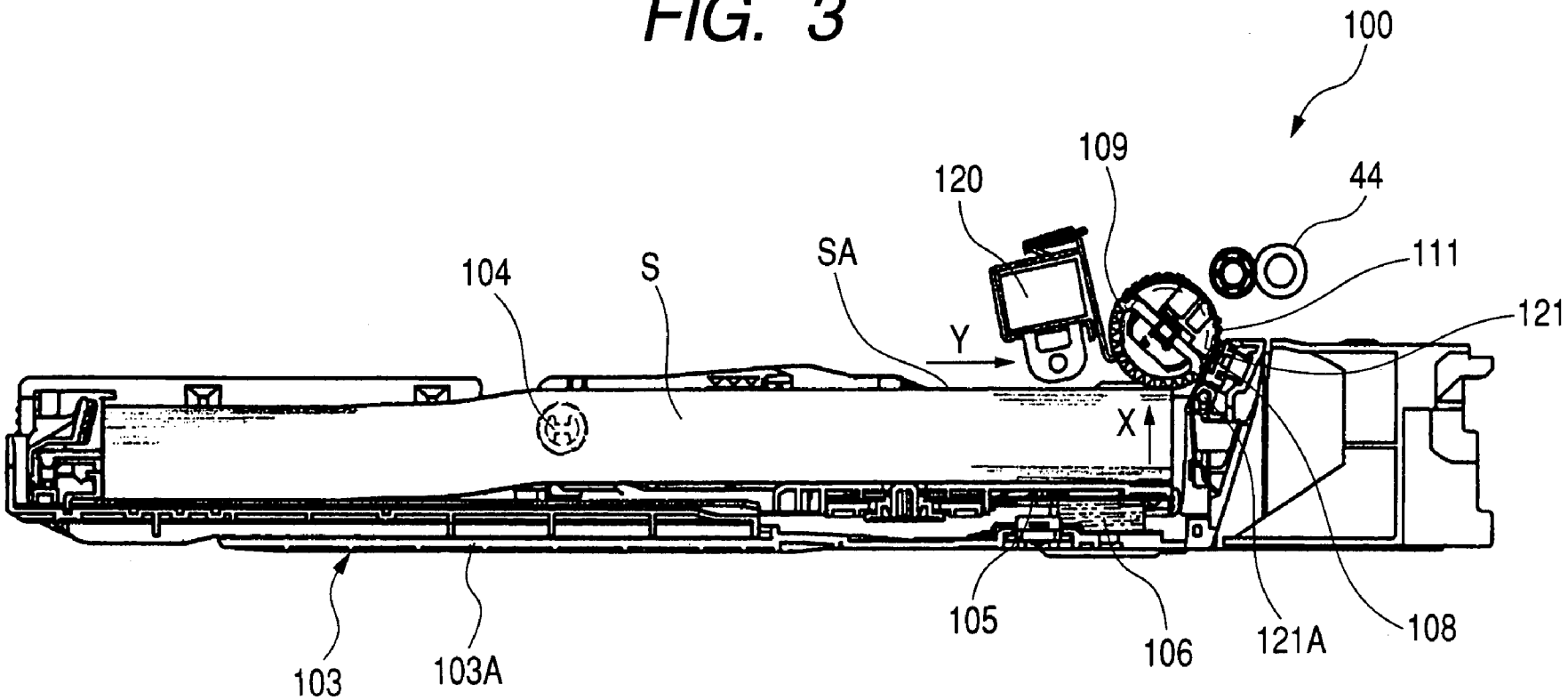
FIG. 3 is a cross-sectional view of the sheet feeding apparatus shown in FIG. 1 during feeding.

FIG. 1 is a perspective view of a sheet feeding apparatus 100 according to a first embodiment of the present invention, and FIGS. 2 and 3 show longitudinal cross-sectional views of the sheet feeding apparatus. This sheet feeding apparatus 100 is incorporated, for example, in the above-described image forming apparatus, and can feed 3"×5" to LGL in terms of size, and 60 g/m$^2$ (thin paper) to 163 g/m$^2$ (thick paper) in terms of basis weight (weight per unit area), and further, various sheets such as postcards and envelopes.

The construction of the present embodiment will first be described. The sheet supplying cassette 103 constituted by a box-shaped frame 103A and having an opening upper surface, as shown in FIG. 1 is put in and out from the right side in FIG. 6 along a cassette guide (not shown) provided in the image forming apparatus main body. An stacking plate 105 having an end portion thereof rockably supported by a support shaft 104 is disposed inside the frame 103A of the sheet supplying cassette 103. As shown in FIGS. 2 and 3, a coil spring 106 is disposed between the stacking plate 105 and the bottom of the frame 103A, and by the resilient force of this coil spring 106, the stacking plate 105 is biased in the direction indicated by the arrow X in FIGS. 2 and 3.

A roller rotary shaft 108 supported by the frame of the image forming apparatus main body is disposed above an end portion of the stacking plate 105 which is opposite to the supporting shaft 104 side. A sheet feeding roller 109 of a substantially halfmoon shape as viewed from a side thereof which is the sheet feeding means of the present invention is mounted on the roller rotary shaft 108, and is driven by a driving system having a motor (not shown). Also, on the opposite ends of the sheet supplying roller 109 on the roller rotary shaft 108, there are disposed sheet feeding runners 110 rotatable independently of the driving of the sheet feeding roller 109 and having an outer diameter smaller than the outer diameter of the arcuate surface 109A of the sheet feeding roller 109.

A partially-toothless gear 111 is fixed to one end portion of the roller rotary shaft 108, and the rotation thereof can be regulated by a solenoid. When the regulation is released by the solenoid 120 being switched on by a sheet feeding signal, the partially-toothless gear 111 meshes with the gear (not shown) of the driving system having a motor, whereby the rotation of the motor is transmitted to the roller rotary shaft 108 to thereby rotate the sheet feeding roller 109.

When the stacking plate 105 is biased and pivotally moved in the direction indicated by the arrow X by the resilient force of the coil spring 106, the uppermost sheet SA of the sheets S stacked on the stacking plate 105 contacts with the sheet feeding roller 109 or the sheet feeding runner 110 and the pivotal movement of the stacking plate 105 is stopped to thereby bring about a sheet feeding state.

Also, a double feed preventing separating pad 121 pivotable about a support shaft 121A is mounted on the sheet supplying cassette 103 so as to be urged against the sheet feeding roller 109 and the sheet feeding runner 110 by a spring (not shown). Even if two sheets are fed together by the sheet feeding roller 109, the separating pad 121 stops the underlying sheet and separates and feeds only the uppermost sheet SA. Further downstream of the separating pad 121 with respect to the feeding direction thereof, there are disposed the pair of registration rollers 44 supported by the frame of the image forming apparatus, and the separated sheet is nipped between this pair of registration rollers 44 and conveyed toward the image forming portion by this pair of registration rollers 44.

When in a waiting state in which as shown in FIG. 2, the arcuate surface 109A partly disposed on the outer periphery of the sheet feeding roller 109 is located on the upper side, even if the stacking plate 105 is pivotally moved in the direction indicated by the arrow X by the resilient force of the coil spring 106, the sheet feeding runner 110 contacts with the uppermost sheet SA and does not contact with the arcuate surface 109A and therefore, the sheet is not fed. Also, when as shown in FIG. 3, the arcuate surface 109A is located on the lower side by the rotation of the sheet feeding roller 109, it contacts with the uppermost sheet SA. Therefore, the sheet SA is fed in the direction indicated by the arrow Y by the rotation of the sheet feeding roller 109 with the aid of the frictional force thereof with the arcuate surface 109A.

The essential portions of the present invention will now be described with reference also to FIGS. 4A to 4D and FIGS. 5A to 5D. FIGS. 4A to 4D show a case where the stack amount of sheets stacked on the stacking plate 105 is great (full stack), and FIGS. 5A to 5D show a case where the stack amount of sheets is small (medium stack).

Figure 4A:
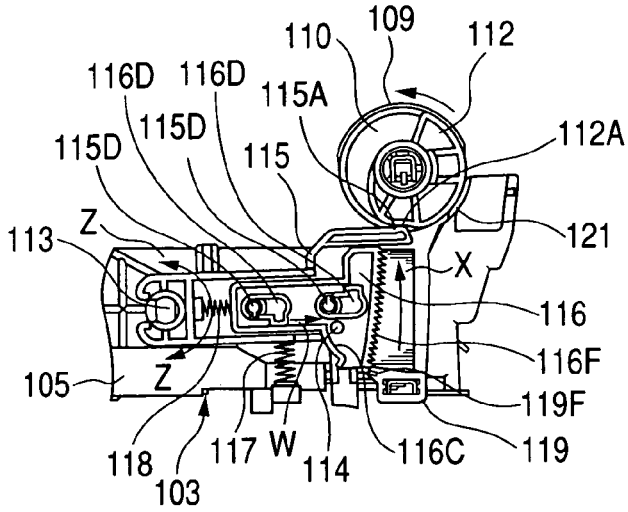
FIGS. 4A, 4B, 4C and 4D illustrate the operation during the full stacking of sheets in the sheet feeding apparatus shown in FIG. 1.

As shown in FIG. 1, sheet feeding cams 112 are mounted on the opposite end portions of the roller rotary shaft 108. Also, as shown in FIG. 4A, a depressing arm 115 supported by a support shaft 113 provided in the frame 103A is mounted on the sheet supplying cassette 103 for rocking movement in the direction indicated by the arrow Z in FIG. 4A. An upper end projected portion 115A is formed on the upper portion of the depressing arm 115, and design is made such that the depressing arm 115 is upwardly biased by a coil spring 117, whereby the upper end projected portion 115A always frictionally contacts with the outer peripheral surfaces of the sheet feeding cams 112. Therefore, by the sheet feeding cams 112 being rotated, the depressing arm 115 rocks in the direction indicated by the arrow Z along the profile of the sheet feeding cams 112 with the support shaft 113 as a fulcrum.

Also, a depressing pawl 116 is provided inside this depressing arm 115, and the depressing pawl 116 is movable in a direction indicated by the arrow W in FIG. 4A intersecting with the rocking direction of the depressing arm 115, or a direction opposite thereto, by the slot 116D of the depressing arm 115 being engaged with a guide pin 115D provided on the depressing arm 115. The depressing arm 115 and the depressing pawl 116 together constitute the depressing portion of the present invention.

Also, the depressing pawl 116 is always biased in the direction indicated by the arrow W in FIG. 4A by a coil spring 118, and has its position determined by a cam surface 116C formed on the depressing pawl 116 frictionally contacting with a pin 114 fixed to the frame 103A of the sheet supplying cassette 103. The cam surface 116C and the pin 114 together constitute the guide means of the present invention. The depressing pawl 116 is provided with pawl portions 116F along the rocking direction (vertical direction) of the depressing arm 115, and an stacking plate pawl 119 which is the engagement portion of the present invention is attached to the fore end side of the stacking plate 105 in opposed relationship with the pawl portion 116F.

By the depressing arm 115 rocking, the cam surface 116C slides on the pin 114 and the depressing pawl 116 is moved, and when the depressing arm 115 rocks upwardly, the depressing pawl 116 is moved in a direction away from the stacking plate pawl 119 (a direction opposite to the direction indicated by the arrow W in FIG. 4A) against the resilient force of the oil spring 118, and when the depressing arm 115 rocks downwardly, the pawl portion 116F of the depressing pawl 116 is moved by the resilient force of the coil spring 118 so as to be engaged with the stacking plate pawl 119, and also depresses the engaged stacking plate pawl 119 and rocks the stacking plate 105 by a constant amount in a direction opposite to the direction indicated by the arrow X. When the depressing arm 115 arrives at the lowermost end, the cam surface 116C and the pin 114 become disengaged from each other (the state of FIGS. 4A and 5A).

Figure 4B:
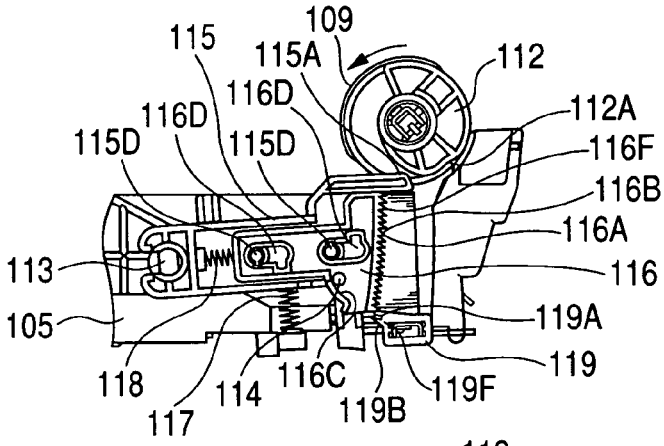

As shown in FIG. 4B, the pawl portion 116F of the depressing pawl 116 is provided with a locking surface 116A and a tapered surface 116B, and the pawl portion 119F of the stacking plate pawl 119 is also provided with a locking surface 119A and a tapered surface 119B, and when an attempt is made to rock the stacking plate 105 in the direction opposite to the direction indicated by the arrow X, the tapered surface 116B of the depressing pawl 116 and the tapered surface 119B of the stacking plate pawl 119 come into engagement with each other and therefore, the depressing pawl 116 escapes in the direction opposite to the direction indicated by the arrow W, and the stacking plate 105 does not have its movement regulated but can be smoothly rocked. Also, when an attempt is made to rock the stacking plate 105 in the direction indicated by the arrow X, the locking surface 116A of the depressing pawl 116 and the locking surface 119A of the stacking plate pawl 119 come into engagement with each other, and the depressing pawl 116 cannot move in the direction opposite to the direction indicated by the arrow W, and the stacking plate 105 has its rocking movement regulated. Thus, a ratchet mechanism which is regulated in movement in one direction and is free in movement in the other direction is constituted by the pawl portion 116F of the depressing pawl 116 and the pawl portion 119F of the stacking plate pawl 119.

In the sheet supplying cassette 103, there is provided an stacking plate locking mechanism (not shown) for locking the stacking plate 105 in its depressed position when the stacking plate 105 is downwardly depressed in a state in which the cassette has been drawn out of the image forming apparatus main body. Thereby, the stacking space for the sheets S can be secured widely and the sheets S can be easily set on the stacking plate 105. When the sheet supplying cassette 103 is mounted on the image forming apparatus main body with the stacking plate 105 locked by the stacking plate locking mechanism, the locking of the stacking plate 105 by the stacking plate locking mechanism is released in the course of mounting by an stacking plate lock releasing portion (not shown) formed on a cassette guide.

A series of sheet feeding operations in the sheet feeding apparatus 100 according to the first embodiment will now be described with reference to FIGS. 4A to 4D and FIGS. 5A to 5D. As previously described, FIGS. 4A to 4D show the case where the stack amount of sheets stacked on the stacking plate 105 is great (full stack), and FIGS. 5A to 5D show the case where the stack amount of sheets is small (medium stack).

When the stacking plate 105 is depressed with the sheet supplying cassette 103 drawn out of the image forming apparatus main body, the stacking plate 105 is locked by the stacking plate locking mechanism (not shown), and in that state, a bundle of sheets is set on the stacking plate 105. Next, when the sheet supplying cassette 103 is mounted on the image forming apparatus main body, the locking by the stacking plate locking mechanism is released by the stacking plate lock releasing portion. At this time, the depressing arm 115 mounted on the sheet supplying cassette 103 is mounted while contacting with the sheet feeding cams 112 mounted on the roller rotary shaft 108.

Figure 5A:
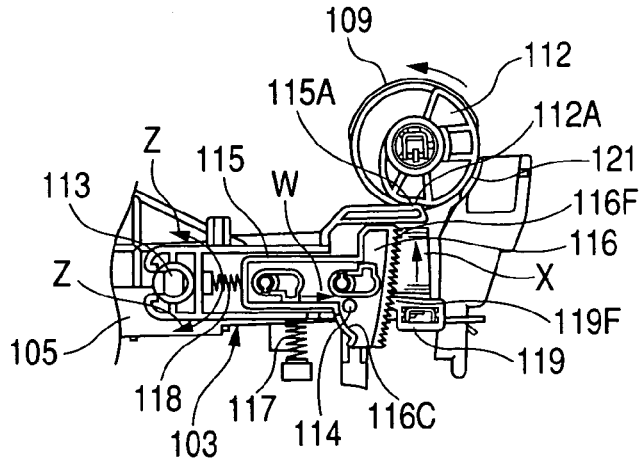
FIGS. 5A, 5B, 5C and 5D illustrate the operation during the medium stacking of sheets in the sheet feeding apparatus shown in FIG. 1.

When as shown in FIGS. 4A and 5A, the sheet supplying cassette 103 is mounted at a predetermined position, the upper end projected portion 115A provided on the depressing arm 115 and the groove portions 112A of the sheet feeding cams 112 are engaged with each other, and the sheet feeding roller 109 and partially-toothless gear 111 mounted coaxially with the sheet feeding cams 112 are held in an initial waiting position (home position) In this state, the pawl portion 116F of the depressing pawl 116 is in engagement with the pawl portion 105F of the stacking plate 105, and the upper surface of the stacked sheets S and the sheet feeding runner 110 are spaced apart from each other.

Figure 5B:
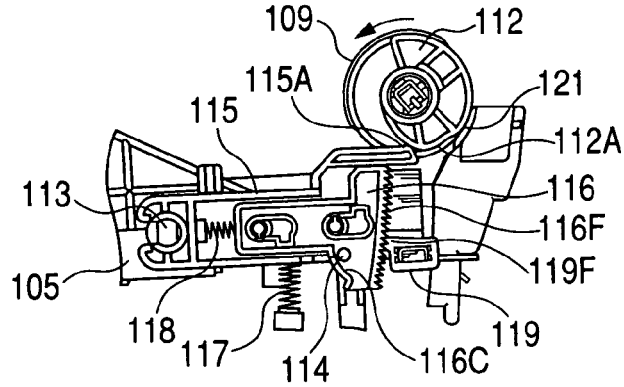

When the roller rotary shaft 108 begins to be rotated on the basis of a sheet feeding signal, the sheet feeding roller 109 and the sheet feeding cams 112 are rotated. The depressing arm 115 is upwardly biased by the resilient force of the coil spring 117 and the upper end projected portion 115A is constantly in contact with the sheet feeding cams 112 and therefore, the upper end projected portion 115A is moved along the profile of the sheet feeding cams 112. Thereby, the depressing arm 115 is upwardly rocked about the support shaft 113. The depressing pawl 116 attached to the depressing arm 115 is likewise upwardly rocked about the support shaft 113. At that time, the stacking plate 105 is also upwardly rocked in timed relationship with the rocking movement of the depressing pawl 116, but the uppermost sheet SA stacked on the stacking plate 105 is neither in contact with the sheet feeding roller 109 nor the sheet feeding runner 110. (FIGS. 4B and 5B).

Figure 4C:
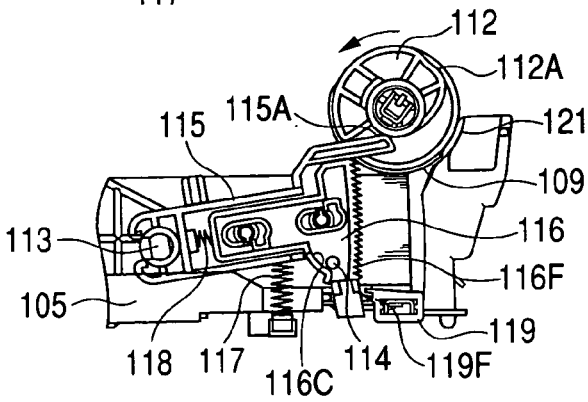
Figure 5C:
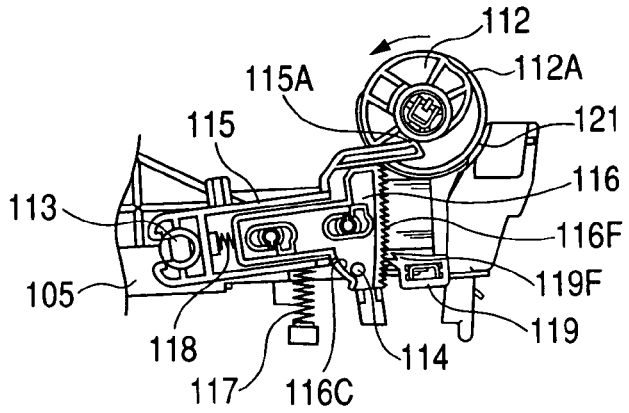

When the sheet feeding roller 109 is further rotated, the depressing arm 115 is further rocked upwardly and the cam surface 116C formed on the depressing pawl 116 frictionally contacts with the pin 114 fixed to the frame 103A of the sheet supplying cassette 103, and the depressing pawl 116 is substantially horizontally moved in the direction opposite to the direction indicated by the arrow W in the depressing arm 115. Thereby, the engagement between the depressing pawl 116 and the pawl portion 119F of the stacking plate pawl 119 attached to the stacking plate 105 is released and the regulation of the stacking plate. 105 is released. The stacking plate 105 is always upwardly biased by the coil spring 106 and therefore, when the regulation is released, the stacking plate 105 is moved up in the direction indicated by the arrow X about the support shaft 104. Then, the uppermost sheet SA stacked on the stacking plate 105 is brought into pressure contact with the sheet feeding runner 110 (FIGS. 4C and 5C). The sheet feeding roller 109 is further rotated, whereby the sheet SA is fed in the direction indicated by the arrow Y in FIG. 2 by the friction between the sheet feeding roller 109 and the uppermost sheet SA.

Figure 4D:
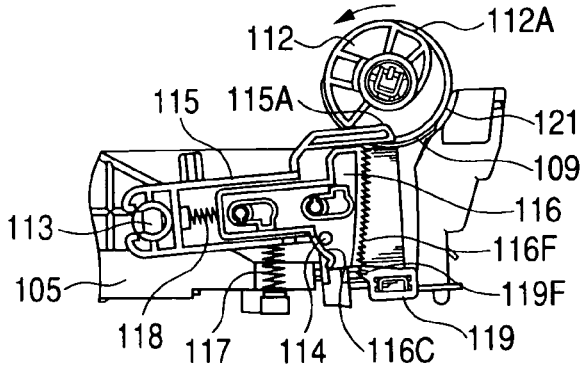
Figure 5D:
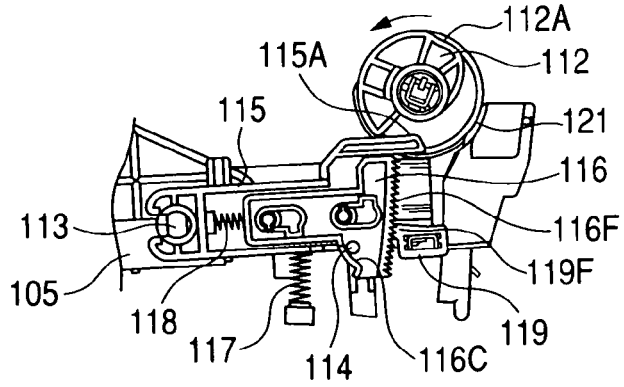

When the thus fed sheet comes into between the sheet feeding roller 109 and the separating pad 121, the depressing arm 115 is downwardly rocked about the support shaft 113 formed in the sheet supplying cassette 103 against the resilient force of the coil spring 117 by the sheet feeding cams 112. When the depressing arm 115 is downwardly rocked, the depressing pawl 116 is moved in the direction indicated by the arrow W in the depressing arm 115 by the coil spring 118 with the cam surface 116C frictionally contacting with the pin 114. Then, the depressing pawl 116 and the stacking plate pawl 119 attached to the stacking plate 105 come into engagement with each other (FIGS. 4D and 5D). At this time, the locking surface 116A of the depressing pawl 116 and the locking surface 119A of the stacking plate pawl 119 come into engagement with each other and therefore, with the lowering of the pawl portion 116F of the depressing pawl 116, the stacking plate pawl 119 is also lowered and the stacking plate 105 is depressed.

By the depressing arm 115 being thus downwardly rocked by the sheet feeding cams 112, the stacking plate pawl 119 is depressed, whereby the stacking plate 105 is rocked in the direction opposite to the direction indicated by the arrow X against the resilient force of the coil spring 106, to thereby provide a predetermined amount of interstice between the upper surface of the uppermost sheet SA stacked on the stacking plate 105 and the sheet feeding roller 109. Thereafter, when the sheet feeding roller 109 is further rotated, the upper end projected portion 115A provided on the depressing arm 115 and the groove portions 112A of the sheet feeding cams 112 come into engagement with each other as shown in FIGS. 4A and 5A, and the sheet feeding roller 109 and partially-toothless gear 111 mounted coaxially with the sheet feeding cams 112 are held in the initial waiting position (home position). Thereafter, the uppermost sheet SA is nipped between the sheet feeding roller 109 and the separating pad 121 and is separated and conveyed toward the pair of registration rollers 44 provided on the downstream side, and the sheet is further conveyed to the image forming portion by the pair of registration rollers 44. If the sheet feeding roller 109 is continuedly rotated, the next sheet S can be continuously fed in the same manner as that described above.

In such moving-up-and-down operation of the stacking plate 105, even if the stack amount (stack height) of the sheets S stacked on the stacking plate 105 differs as shown in FIGS. 4A to 4D and FIGS. 5A to 5D, the position in which the plurality of pawl portions 116F provided on the depressing pawl 116 and the pawl portion 119F of the stacking plate pawl 119 are engaged with each other changes, whereby substantially at the same timing from the start of the rotation of the sheet feeding roller 109, the stacking plate 105 can be moved in a direction away from the sheet feeding roller 109 and further, a predetermined amount of interstice can be provided between the uppermost surface of the stacked sheets and the sheet feeding roller 109.

That is, the timing (the state of FIGS. 4D and 5D) at which the pawl portions 116F provided on the depressing pawl 116 and the pawl portion 119F of the stacking plate pawl 119 are engaged with each other is constant irrespective of the stack amount (stack height) of the sheets stacked on the stacking plate 105. This is because the upper end projected portion 115A of the depressing arm 115 is always pushed against the sheet feeding cams 112 and the start of the depression of the depressing arm 115 and the start of the movement of the depressing pawl 119 toward the stacking plate 105 are primarily determined by the profile of the sheet feeding cams 112 and the profile of the cam surface 116C and therefore, always at the same timing from the start of the rotation of the sheet feeding roller 109, the pawl portions 116F of the depressing pawl 116 and the pawl portion 119F of the stacking plate pawl 119 are engaged with each other and the stacking plate 105 is depressed.

Also, even if the stack amount (stack height) of the sheets stacked on the stacking plate 105 differs, the amount by which the depressing arm 115 is depressed after the pawl portions 116F provided on the depressing pawl 116 and the pawl portion 119F of the stacking plate pawl 119 in the state of FIGS. 4D and 5D have been engaged with each other is primarily determined by the profile of the sheet feeding cams 112 as shown by the state of FIGS. 4A and 5A and therefore, the stacking plate 105 is lowered by a constant amount and the uppermost surface of the sheets S stacked thereon also becomes spaced apart by a constant amount from the sheet feeding roller 109.

This lowering operation of the stacking plate 105 is set so as to be performed when the leading edge of the fed sheet is located between the separating pad 121 and the pair of registration rollers 44, and the sheet feeding force is eliminated at the same timing from the feeding-out of the sheet, whereby even if two sheets are fed together to the separating pad 121, the separation of the sheets can be reliably effected to thereby remarkably improve the separating performance by the separating pad 121.

Also, the trailing edge of the sheet separated by the separating pad 121 and being conveyed by while being nipped between the pair of registration rollers 44 is upstream of the sheet feeding runner 110, but a predetermined amount of interstice is provided between the sheet and the sheet feeding runner 110 with the stacking plate 105 depressed and therefore, the sheet can be conveyed in a state in which no frictional force is produced between the separated sheet and the upper surface of the sheets S stacked on the stacking plate 105. Therefore, the conveying force of the pair of registration rollers 44 can be made small, and the downsizing and electric power saving of the driving system can be achieved.

Further, since a predetermined amount of interstice is provided between the separated sheet and the sheet feeding runner 110, back tension to the sheet decreases, and even if the conveying speed in the image forming portion downstream of the pair of registration rollers 44 becomes higher than the conveying speed of the pair of registration rollers 44, the back tension of the pair of registration rollers 44 is mitigaged by a one-way clutch mechanism being provided for the pair of registration rollers 44 and therefore, influence upon the conveyance in the image forming portion is small, and for example, in an in-line color image forming apparatus using a transfer belt, the amounts of color misregister of respective colors can be greatly mitigated.

While the present embodiment is of a construction in which one of a number of pawl portions 116F provided on the depressing pawl 116 and the pawl portion 119F provided on the stacking plate 105 are engaged with each other in accordance with the position of the stacking plate 105, conversely a number of pawl portions may be provided on the stacking plate 105 so that the pawal portion provided on the depressing pawl 116 may be engaged with one of these many pawal portions.

Also, while in the present embodiment, the stacking plate 105 and the stacking plate pawl 119 are discrete parts, there may be adopted a construction in which the stacking plate pawl 119 is provided integrally with the stacking plate 105, and the stacking plate 105 and the depressing pawl 116 are engaged with each other to thereby depress the stacking plate 105 by a predetermined amount. Also, the depressing arm 115 performs rocking motion, whereas this is not restrictive, but it may be made to perform vertical motion. Also, the depressing pawl performs substantially horizontal motion, whereas this is not restrictive, but it may be made to perform rocking motion.

OTHER EMBODIMENT

FIGS. 7A to 7D show the essential portions of a sheet feeding apparatus according to a second embodiment of the present invention, and the sheet feeding apparatus according to the second embodiment will hereinafter be described with reference to these FIGS. 7A to 7D. The same members as those in the first embodiment need not be described. The sheet feeding apparatus according to the present embodiment, like that according to the first embodiment, is also mounted on an image forming apparatus.

A depressing pawl 123 which is the depressing portion of the present invention is formed with a slidable upper end projected portion 123A on the outer peripheries of the sheet feeding cams 112, and cam slots 123B in which support shafts 125 fixed to the frame 103A of the sheet supplying cassette 103 slide. The guide means of the present invention is constituted by the support shafts 125 and the cam slots 123B. Also, the depressing pawl 123 is always biased obliquely upwardly by a coil spring 124, and the upper end projected portions 123A frictionally contact with the outer peripheral surfaces of the sheet feeding cams 112, and the sheet feeding cams 112 are rotated, whereby the depressing pawl is movable in the direction indicated by the arrow V along the profile of the cam slots 123B.

Description will now be made of a series of feeding operations of the sheet feeding apparatus according to the present embodiment. FIGS. 7A to 7D show a case where the amount of sheets stacked on the stacking plate 105 is great (full stack).

Figure 7A:
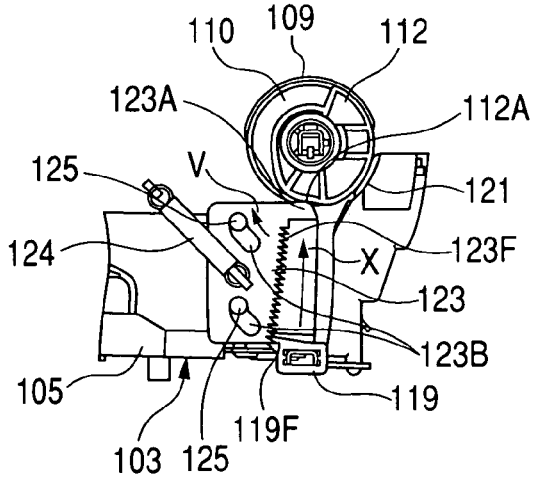
FIGS. 7A, 7B, 7C and 7D illustrate the operation during the full stacking of sheets in a second embodiment of the present invention.

When as shown in FIG. 7A, the sheet supplying cassette 103 is mounted at a predetermined position, the upper end projected portion 123A provided on the depressing pawl 123 and the groove portions 112A of the sheet feeding cams 112 are engaged with each other, and the sheet feeding roller 109 and partially-toothless gear 111 attached coaxially with the sheet feeding cams 112 are held in the initial waiting position (home position). In this state, the pawl portion 123F of the depressing pawl 123 is in engagement with the pawl portion 105F of the stacking plate 105, and the upper surface of the stacked sheets S and the sheet feeding runner 110 are spaced apart from each other.

Figure 7B:
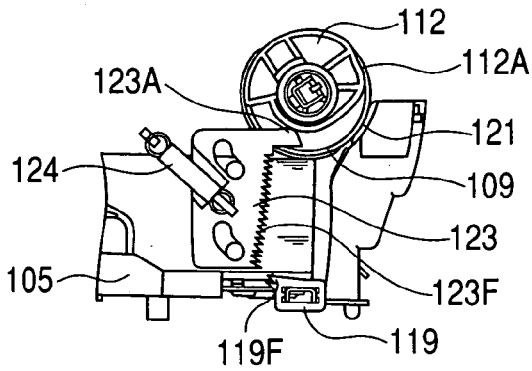

When the roller rotary shaft 108 begins to be rotated on the basis of a sheet feeding signal, the sheet feeding roller 109 and the sheet feeding cams 112 are rotated. The depressing pawl 123 is biased obliquely upwardly by the coil spring 124 and the upper end projected portion 123A is constantly in contact with the sheet feeding cams 112 and therefore, the upper end projected portion 123A moves along the profile of the sheet feeding cams 112. Thereby, the depressing pawl 123 is moved in the direction indicated by the arrow V by the support shafts 125 and the cam slots 123B, and the engagement between the depressing pawl 123 and the stacking plate pawl 119 is released and the regulation of the stacking plate 105 is released. The stacking plate 105 is always biased upwardly by the coil spring 106 and therefore, the stacking plate 105 rocks in the direction indicated by the arrow X in FIG. 7A about the support shaft 104. Then, the uppermost sheet SA stacked on the stacking plate 105 is brought into contact with the sheet feeding roller 110 (FIG. 7B). Further, the sheet feeding roller 109 is rotated, whereby the sheet SA is fed in the direction indicated by the arrow Y indicated in FIG. 2 by the friction between the sheet feeding roller 109 and the uppermost sheet SA.

Figure 7C:
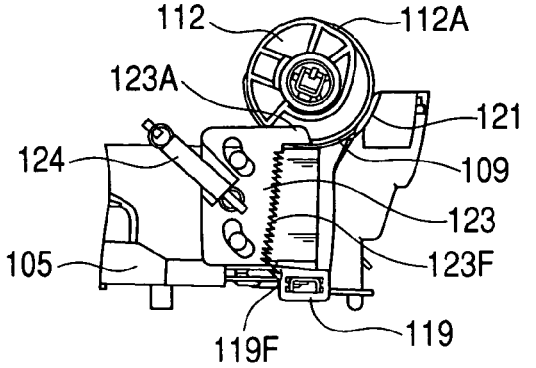
Figure 7D:
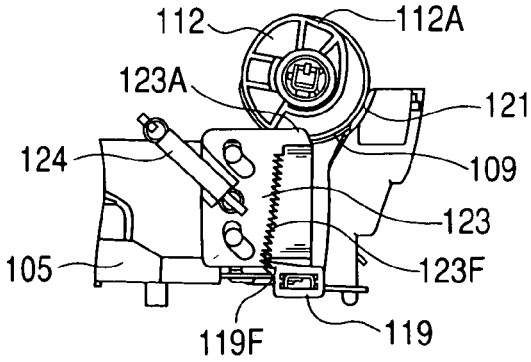

When the thus fed sheet comes into between the sheet feeding roller 109 and the separating pad 121, the depressing pawl 123 is downwardly depressed by the sheet feeding cams 112 against the resilient force of the coil spring 124, and the depressing pawl 123 is moved in a direction opposite to the direction indicated by the arrow V by the cam slots 123B and the support shafts 125 (FIG. 7C). Then, the depressing pawl 123 and the stacking plate pawl 119 attached to the stacking plate 105 are engaged with each other (FIG. 7D). As in the first embodiment, the pawl portion 123F of the depressing pawl 123 is provided with a locking surface and a tapered surface and at this time, the locking surface of he pawl portion 123F comes into engagement with the lock surface 119A of the stacking plate pawl 119 and therefore, with the lowering of the pawl portions 116F of the depressing pawl 116, the stacking plate pawl 119 is also lowered and the stacking plate 105 is depressed.

The depressing pawl 123 is further downwardly depressed by the sheet feeding cams 112, whereby the stacking plate 105 biased in the direction indicated by the arrow X by the coil spring 106 is rocked in the direction opposite to the direction indicated by the arrow X against the biasing force to thereby provide a predetermined amount of interstice between the upper surface of the uppermost sheet SA stacked on the stacking plate 105 and the sheet feeding roller 109. Then, as shown in FIG. 7A, the upper end projected portion 123A provided on the depressing pawl 123 and the groove portions 112A of the sheet feeding cams 112 are engaged with each other, and the sheet feeding roller 109 and partially-toothless gear 111 mounted coaxially with the sheet feeding cams 112 are held in the initial position (home position).

In such upward and downward movement of the stacking plate 105, even if the stack amount (stack height) of the sheets S stacked on the stacking plate 105 differs, the position at which the plurality of pawl portions 123F provided on the depressing pawl 123 and the pawl portions 119F of the stacking plate pawl 119 are engaged with each other changes, whereby substantially at the same timing from the start of the rotation of the sheet feeding roller 109, the stacking plate 105 can be moved in a direction away from the sheet feeding roller 109 and further, a constant amount of interstice can be provided between the uppermost surface of the stacked sheets and the sheet feeding roller 109.

That is, the timing at which the pawl portions 123F provided on the depressing pawl 123 and the pawl portions 119F of the stacking plate pawl 119 are engaged with each other is constant irrespective of the stack amount (stack height) of the sheets stacked on the stacking plate 105. This is because the upper end projected portion 123A of the depressing pawl 123 is always pushed against the sheet feeding cams 112 and the start of the depression of the depressing pawl 123 and the engagement of the pawl portions 123F of the depressing pawl 123 with the stacking plate are primarily determined by the profile of the sheet feeding cams 112 and therefore, always at the same timing from the start of the rotation of the sheet feeding roller 109, the pawl portions 123F of the depressing pawl 123 and the pawl portions 119F of the stacking plate pawl 119 are engaged with each other and the stacking plate 105 is depressed.

Also, even if the stack amount (stack height) of the sheets stacked on the stacking plate 105 differs, after the pawl portions 123F provided on the depressing pawl 123 and the pawl portions 119F of the stacking plate pawl 119 have been engaged with each other, the amount by which the depressing pawl 123 is depressed is primarily determined by the profile of the sheet feeding cam 112 and therefore, the stacking plate 105 is lowered by a constant amount and the uppermost surface of the stacked sheets S is also spaced apart by a constant amount from the sheet feeding roller 109.

The lowering operation of this stacking plate 105 is set so as to be performed when the leading edge of the fed-out sheet is located between the separating pad 121 and the pair of registration rollers 44, and the sheet feeding force is eliminated at the same timing from the feeding-out of the sheet, whereby even if two sheets are fed together to the separating pad 121, the separation of the sheets can be reliably effected and the separating performance by the separating pad 121 can be remarkably improved.

Also, the trailing edge of the sheet separated by the separating pad 121 and being conveyed by while being nipped between the pair of registration rollers 44 is upstream of the sheet feeding runner 110, but the stacking plate 105 is depressed to thereby provide a predetermined amount of interstice between the sheet and the sheet feeding runner 110 and therefore, the sheet can be conveyed in a state in which no frictional force is produced between the separated sheet and the upper surface of the sheets S stacked on the stacking plate 105. Therefore, the conveying force-of the pair of registration rollers 44 can be made small and the downsizing and electric power saving of the driving system can be achieved.

Further, there is a predetermined amount of interstice between the separated sheet and the sheet feeding runner 110 and therefore, back tension to the sheet decreases, and even if the conveying speed in the image forming portion downstream of the pair of registration rollers 44 becomes higher than the conveying speed of the pair of registration rollers 44, the back tension of the pair of registration rollers 44 is mitigated by a one-way clutch mechanism being provided for the pair of registration rollers 44 and therefore, the influence of the image forming portion upon conveyance is small and for example, in an in-line color image forming apparatus using a transfer belt, the amounts of color misregister of respective colors can be greatly mitigated.

While the present embodiment is of a construction in which one of a number of pawl portions 123F provided on the depressing pawl 123 and the pawl portion 119F provided on the stacking plate 105 in accordance with the position of the stacking plate 105 are engaged with each other, conversely a number of pawl portions may be provided on the stacking plate 105 so that a pawl portion provided on the depressing pawl 123 may be engaged with one of these number of pawl portions.

Also, while in the present embodiment, the stacking plate 105 and the stacking plate pawl 119 are discrete parts, there may be adopted a construction in which the stacking plate pawl 119 is provided integrally with the stacking plate 105, and the stacking plate 105 and the depressing pawl 123 are brought into engagement with each other and the stacking plate 105 is depressed by a predetermined amount.

While in each of the above-described embodiments, description has been made of an example in which the present invention is applied to a sheet feeding apparatus using a sheet supplying cassette, the present invention is not restricted thereto, but the present invention can also be applied, for example, to a so-called mutli-sheet feeding apparatus in which a bundle of sheets is manually set on a rocking tray.

This application claims priority from Japanese Patent Application No. 2004-329238 filed Nov. 12, 2004, which is hereby incorporated by reference herein.

What is claimed is:

1. A sheet feeding apparatus comprising:

a stacking plate pivotable with sheets stacked thereon;

a sheet feeding roller, which feeds the sheets stacked on said stacking plate, in a sheet feeding direction;

biasing means, which biases said stacking plate toward said sheet feeding roller;

a sheet feeding cam, which is rotated in operative association with a rotation of said sheet feeding roller; and a depressing mechanism, which is movably supported in a moving direction along the sheet feeding direction to engage said stacking plate, and in a depressing direction in which said depressing mechanism depresses said stacking plate by a constant amount in operative association with a rotation of said sheet feeding cam against a biasing force of said biasing means, wherein either said depressing mechanism or said stacking plate is provided with a plurality of pawls along the depressing direction, and the other is provided with an engagement portion engageable with said pawls, and wherein while said depressing mechanism is moved in operative association with a rotation of said sheet feeding cam, one of said pawls and said engagement portion are engaged with each other during the sheet feeding process and said depressing mechanism subsequently depresses said stacking plate by a constant amount in the depressing direction.

2. A sheet feeding apparatus according to claim 1, wherein said depressing mechanism has a depressing portion constantly engaged with said sheet feeding cam, and guide means for guiding said depressing portion so as to move said depressing portion in a direction in which said plurality of pawls and said engagement portion are engaged with each other by a rotation of said sheet feeding cam, and subsequently move said stacking plate in the depressing direction.

3. A sheet feeding apparatus according to claim 2, wherein said guide means is a cam surface or a cam slot provided with a predetermined profile.

4. A sheet feeding apparatus according to claim 2, wherein said depressing mechanism is provided with a clutch for stopping the rotation of said sheet feeding roller with said stacking plate spaced apart by a constant distance from said sheet feeding roller.

5. A sheet feeding apparatus comprising:

a stacking plate pivotable with sheets stacked thereon;

a sheet feeding roller disposed above said stacking plate so as to contact with the sheets stacked on said stacking plate to thereby feed the sheets in a sheet feeding direction;

a spring, which biases upwardly said stacking plate to bring the sheets stacked on said stacking plate into pressure contact with said sheet feeding roller; and a depressing mechanism, which depresses said stacking plate in a depressing direction against a biasing force of said spring, said depressing mechanism including:

a sheet feeding cam fixed to a rotary shaft of said sheet feeding roller;

a depressing arm provided in contact with said sheet feeding cam, and movably supported in a moving direction along the sheet feeding direction to engage the stacking plate and in a depressing direction by a constant amount by a rotation of said sheet feeding cam, and a depressing pawl member provided with a plurality of pawls engageable with said stacking plate along the depressing direction, and held on said depressing arm, wherein when said depressing arm is depressed by said sheet feeding cam during the sheet feeding process, said depressing pawl member is moved in the moving direction toward said stacking plate and one of said pawls is engaged with said stacking plate, and said depressing arm depresses said stacking plate in the depressing direction by a constant amount.

6. A sheet feeding apparatus according to claim 5, further comprising:

a spring for biasing the pawls of said depressing pawl member in a direction to be engaged with said stacking plate; and a cam mechanism having a cam surface for guiding said depressing pawl member so as to move said depressing pawl member in accordance with a position of said depressing arm between a position in which one of said pawls is not engaged with said stacking plate against a biasing force of said spring and a position in which one of said pawls is engaged with said stacking plate, wherein at a start of a depression of said depressing arm by said sheet feeding cam, said depressing pawl member is moved from the position in which one of said pawls is not engaged with said stacking plate to the position in which one of said pawls is engaged with said stacking plate by the cam surface of said cam mechanism, and an engaged state of one of said pawls and said stacking plate is maintained by said spring and said stacking plate is depressed by a constant amount by a rocking movement of said depressing arm.

7. A sheet feeding apparatus according to claim 5, further comprising a clutch for stopping a rotation of said sheet feeding roller in a position in which said stacking plate has been depressed by a constant amount by said depressing arm and said depressing pawl member.

8. A sheet feeding apparatus according to claim 5, wherein said stacking plate is provided with a pawl portion at a position where at said stacking plate is engaged with the pawls of said depressing mechanism, and the pawl portion of said stacking plate and the pawls of said depressing mechanism together constitute a ratchet mechanism for permitting said stacking plate to be lowered and regulating an upward movement of said stacking plate in an engaged state.

9. An image forming apparatus comprising:

a sheet feeding apparatus according to any one of claims 1 to 8; and an image forming portion for forming an image on a sheet fed from said sheet feeding apparatus.

* * * * *

UNITED STATES PATENT AND TRADEMARK OFFICE

CERTIFICATE OF CORRECTION

PATENT NO. : 7,364,152 B2
APPLICATION NO. : 11/008974
DATED : April 29, 2008
INVENTOR(S) : Suwa It is certified that error appears in the above-identified patent and that said Letters Patent is hereby corrected as shown below:

ON THE TITLE PAGE:
At Item (57), Abstract, Line 5, “an stacking” should read --a stacking--.

COLUMN 1:
Line 13, “an stacking” should read --a stacking--.
Line 25, “an stacking” should read --a stacking--.

COLUMN 2:
Line 33, “an stacking” should read --a stacking--.
Line 66, “spring, the depressing” should read --spring. The depressing--.

COLUMN 3:
Line 11, “portion come” should read --portion comes--.
Line 12, “depress” should read --depresses--.
Line 30, “come” should read --comes--.
Line 31, “depress” should read --depresses--.

COLUMN 4:
Line 64, “An stacking” should read --A stacking--.

COLUMN 6:
Line 37, “an stacking” should read --a stacking--
Line 47, “oil spring 118,” should read --coil spring 118,--.

COLUMN 7:
Line 15, “provided an” should read --provided a--.
Line 27, “an stacking” should read --a stacking--.
Line 56, “position) In” should read --position). In--.

COLUMN 8:
Line 21, “plate. 105” should read --plate 105--.
Line 32, “comes into between” should read --comes in between--.

COLUMN 10;
Line 11, “mitigaged” should read --mitigated--.
Line 24, “pawal portion” should read --pawl portion--.
Line 26, “pawal portions.” should read --pawl portions.--.

UNITED STATES PATENT AND TRADEMARK OFFICE

CERTIFICATE OF CORRECTION

PATENT NO. : 7,364,152 B2
APPLICATION NO. : 11/008974
DATED : April 29, 2008
INVENTOR(S) : Suwa It is certified that error appears in the above-identified patent and that said Letters Patent is hereby corrected as shown below:

COLUMN 11:
Line 38, "comes into between" should read --comes in between--.
Line 50, "surface of he" should read --surface of the--.

COLUMN 12:
Line 62, "force-of" should read --force of--.

COLUMN 13:
Line 33, "mutli-sheet" should read --multi-sheet--.

Signed and Sealed this

Eighteenth Day of November, 2008

JON W. DUDAS
*Director of the United States Patent and Trademark Office*